US011371731B2

(12) United States Patent
Vanderplaat et al.

(10) Patent No.: US 11,371,731 B2
(45) Date of Patent: Jun. 28, 2022

(54) HUMIDIFICATION APPARATUS AND METHOD

(71) Applicant: Desert Spring Eco-Products Ltd., Mississauga (CA)

(72) Inventors: Peter Vanderplaat, Mississauga (CA); Kevin R. D'Souza, Mississauga (CA); Armand B. Raz, Toronto (CA)

(73) Assignee: Desert Spring Eco-Products Ltd., Toronto (CA)

( * ) Notice: Subject to any disclaimer, the term of this patent is extended or adjusted under 35 U.S.C. 154(b) by 82 days.

(21) Appl. No.: 16/786,925

(22) Filed: Feb. 10, 2020

(65) Prior Publication Data

US 2021/0247084 A1 Aug. 12, 2021

(51) Int. Cl.
*F24F 11/00* (2018.01)
*F24F 11/64* (2018.01)

(52) U.S. Cl.
CPC ..... *F24F 11/0008* (2013.01); *F24F 11/64* (2018.01)

(58) Field of Classification Search
CPC .... F24F 2130/10; F24F 11/0008; F24F 11/64; F24F 11/62
See application file for complete search history.

(56) References Cited

U.S. PATENT DOCUMENTS 5,795,505 A 8/1998 Burns
6,354,572 B1 3/2002 Menassa
8,794,603 B2 8/2014 Quam
2010/0211224 A1* 8/2010 Keeling ..... F24F 13/0209 700/277
2012/0065795 A1* 3/2012 Blackshaw ..... F24F 11/30 700/295
2012/0259470 A1* 10/2012 Nijhawan ..... G05D 23/1934 700/278
2015/0102114 A1* 4/2015 McFarland ..... F24F 11/30 236/44 A
2016/0054018 A1* 2/2016 Motodani ..... F24F 11/56 700/276
2017/0138624 A1* 5/2017 Khz ..... F24F 11/00
2017/0314789 A1* 11/2017 Kawamura ..... F28D 20/0034
2018/0058710 A1* 3/2018 Lewis ..... F24F 11/30
2018/0209675 A1* 7/2018 Ridder ..... F24F 11/83
(Continued)

FOREIGN PATENT DOCUMENTS

CA 2165114 A1 12/1995
CA 2312402 A1 1/2001
JP 2014204581 A * 10/2014 ..... G05B 15/02

*Primary Examiner* — Nelson J Nieves
(74) *Attorney, Agent, or Firm* — Ridout & Maybee LLP

(57) ABSTRACT

An humidification apparatus establishes geometric properties for humidity loss from a structure relative to inside and outside temperatures and historic performance of that building structure. The humidification apparatus also stores data establishing acceptable relative humidity ranges for the internal and external ambient temperature conditions to which the building structure is exposed. The humidification apparatus obtains weather forecast data for the geographic location of the building. A user inputs a desired level of relative humidity. The humidification apparatus controller then adjusts humidity inside the building according to that input and according to the permissible humidity range for the building in the prevailing external temperature conditions and the weather forecast data.

20 Claims, 2 Drawing Sheets

(56) References Cited

U.S. PATENT DOCUMENTS

| | | | | |
|---|---|---|---|---|
| 2018/0209677 | A1* | 7/2018 | Yang | F24F 11/42 |
| 2019/0309975 | A1* | 10/2019 | Salem | F24F 11/72 |
| 2020/0116377 | A1* | 4/2020 | Heintzelman | F24F 11/59 |
| 2020/0124308 | A1* | 4/2020 | Ota | F24F 11/47 |
| 2020/0370771 | A1* | 11/2020 | Alanqar | F24F 11/65 |
| 2021/0048208 | A1* | 2/2021 | Moffitt | F24F 11/0001 |

* cited by examiner

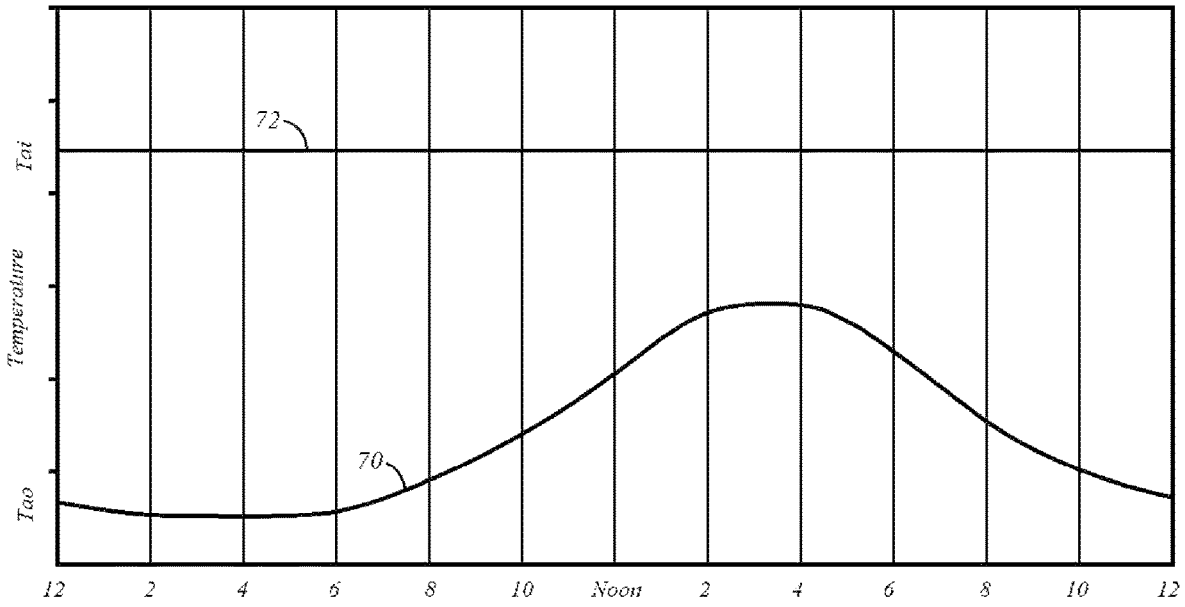
*Fig. 2 - Time v. Temperature*
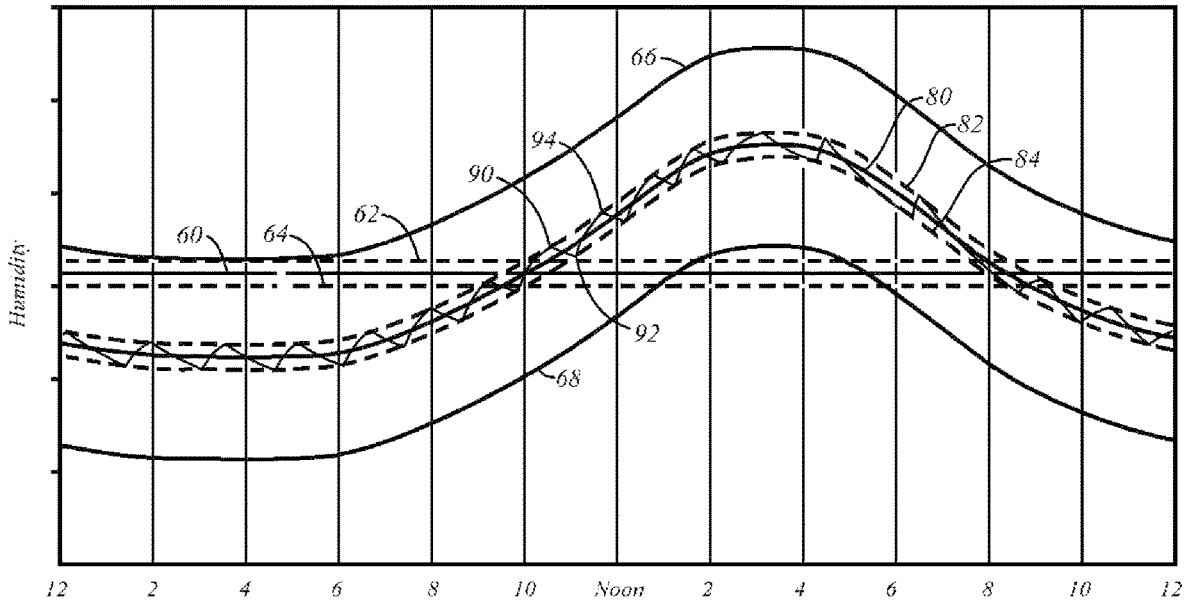
*Fig. 3 - Time v. Humidity*

HUMIDIFICATION APPARATUS AND METHOD

FIELD OF THE INVENTION

This invention relates to the field of humidification apparatus and methods of use thereof.

BACKGROUND OF THE INVENTION

Furnace-mounted air humidifiers are sometimes provided with an electro-mechanical humidistat to provide an automatic on/off control connected to govern operation of the humidifier. If the indoor humidity falls below the humidistat set point, the humidistat will enable the humidifier to add humidity when able. By contrast, if the humidity is at, or above the humidistat set point, power to the humidifier is interrupted to prevent further moisture from being added to the air, and thereby to prevent over-humidification. If the indoor humidity is too low, or too high, it may lead to health-related issues for occupants. These phenomena may include simple dry skin discomfort, or it may be related to more serious respiratory illnesses. Very high or low indoor humidity can also lead to damage inside the home. For example, the prevention of mold is sometimes a significant concern, and may arise as a negative outcome of over-humidification. Mold requires water, which can condense out of the air if the warm humidified indoor air comes in contact with a cold surface, such as a window. A window surface may function as a cold plate condenser. It the temperature of that surface is below the dew point temperature of the internal air, condensate will form. To the extent that a window assembly is a form of thermal resistance, even if it is desired to maintain a constant internal ambient temperature, the surface temperature of the glazing may vary as a function of external temperature.

SUMMARY OF THE INVENTION

In an aspect of the invention there is a method of controlling humidity within a building. The method includes monitoring temperature within the building; monitoring humidity within the building; obtaining weather forecast data; and forward-adjusting humidity within the building as a function of the weather forecast data.

In a feature of that aspect, the method includes storing thermal performance data of the building, and using the thermal performance data in the step of forward adjusting the humidity. In another feature, the method includes collecting thermal performance data from the building over time, calculating thermal performance co-efficients of the building from the thermal performance data; and using the thermal performance co-efficients in the step of forward-adjusting humidity in the building. In another feature, the method includes obtaining the weather forecast data from a data source by at least one of (a) a radio signal; and (b) a telephonic signal. In still another feature, the method includes storing a set of data establishing upper and lower humidity limits, and maintaining humidity adjustments within the upper and lower humidity limits. In a further feature, the method includes establishing upper and lower bands to the humidity set point, and operating an On-Off humidification process between the upper and lower bands of the humidity set point. In still another feature, the method includes monitoring outdoor temperature, comparing outdoor temperature with previously forecast temperature, and adjusting humidification to account for a difference between forecast external ambient temperature and actual external ambient temperature. In still yet another feature, the method includes obtaining external source inputs for at least one of (a) external relative humidity; and (b) precipitation; and calculating alternate thermal properties of the building adjusted therefor, and using the adjusted thermal properties when calculating humidity adjustment.

In another aspect, there is an humidity control apparatus for a building. It has at least a first temperature sensor mounted to monitor temperature inside the building. There is at least a first humidistat at which to a set humidity value is input, and at least a first humidity senor mounted to monitor humidity inside the building. The apparatus has a source of weather forecast data input and a memory of thermal properties of the building. There is a processor connected to manage the inputs and outputs, and to calculate outputs and to monitor operation of the system. The processor is operable to receive input values from at least the first temperature sensor; at least the first humidistat; and the source of weather data. The processor is operable to monitor observed temperature and observed humidity at least at the first temperature sensor and at least at the first humidity sensor respectively. The processor is operable to make a forward projection of humidity level within the building as a function of the weather forecast data input. The control apparatus is operable to output control signals to adjust humidity within the building toward the forward projection of humidity level.

In a feature of that aspect the apparatus includes an "On"-"Off" operation having an hysteresis band. In another feature, the apparatus has a water source input and a valve mounted to control flow through the input, and the controller is operable to output environmental control signals to adjust water flow through the valve. In a further feature, the apparatus is operable to adjust humidity within the building toward the forward projection of humidity level. In still another feature, the apparatus includes at least one sensor mounted to monitor at least one of (a) the amount of airflow (Q) created by the furnace; (b) the temperature of the water supply (Tw) (c) the temperature of the furnace air (Ta). In a further feature, the apparatus includes input data values for at least one of (a) building volume; and (b) building heat loss co-efficients; (c) building moisture loss co-efficients; and (d) building air exchange rate co-efficients.

In a further aspect there is an humidity control apparatus for a building. it has at least a first temperature sensor mounted to monitor temperature inside the building. There is at least a first humidistat at which to a set humidity value is input, and at least a first humidity senor mounted to monitor humidity inside the building. There is a source of weather forecast data input. There is a water source input and a valve mounted to govern flow of water therefrom. The controller has a memory of thermal properties of the building; and a processor. The processor is operable to receive input values from at least the first temperature sensor; at least the first humidistat and the source of weather data. The processor is operable to monitor observed temperature and observed humidity at least at the first temperature sensor and at least at the first humidity sensor respectively. The processor is operable to make a forward projection of humidity level within the building as a function of the weather forecast data input. The controller is operable to output control signals to adjust water flow through the valve.

In another feature, the apparatus is operable to adjust humidity within the building toward the forward projection of humidity level. In still another feature, the apparatus includes at least one sensor mounted to monitor at least one of (a) the amount of airflow (Q) created by the furnace; (b) the temperature of the water supply (Tw); and (c) the temperature of the furnace air (Ta). In another feature the apparatus includes input data values for at least one of (a) building volume; and (b) building heat loss co-efficients; (c) building moisture loss co-efficients; and (d) building air exchange rate co-efficients.

The features of the aspects of the invention may be mixed and matched as appropriate without need for multiplication and repetition of all possible permutations and combinations.

BRIEF DESCRIPTION OF THE DRAWING

These and other aspects and features of the invention may be more readily understood with the aid of the illustrative Figures below, showing an example, or examples, embodying the various aspects and features of the invention, provided by way of illustration, and in which:

FIG. 2 is a table of Temperature v. Time, correlating the set internal temperature of the building to the external fluctuation of temperature over a 24 hour period; and FIG. 3 is a table of Humidity v. Time over the same 24 hour period as in FIG. 2.

DETAILED DESCRIPTION

Figure 1:
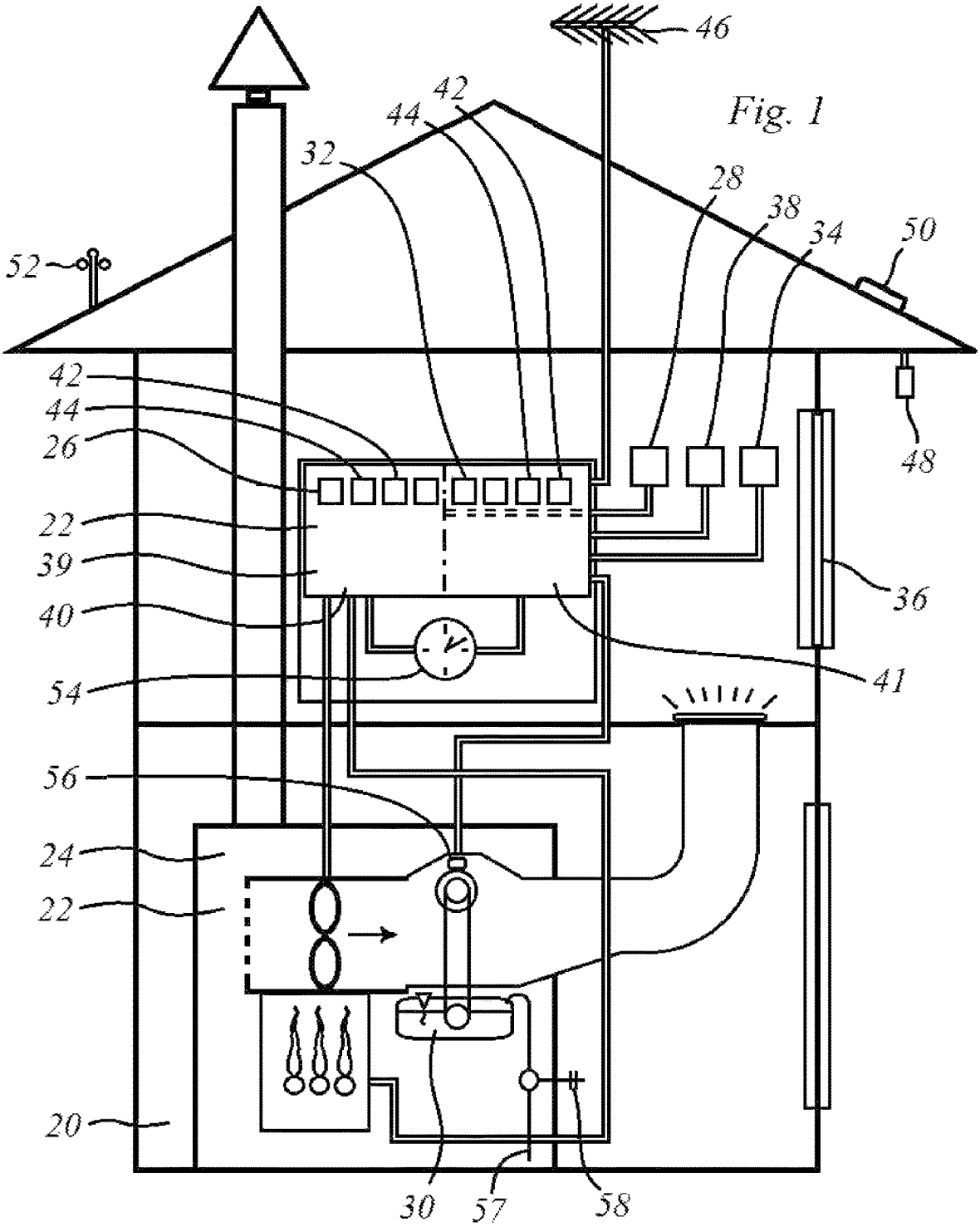
FIG. 1 shows a schematic representation of a building, such as a house, and elements of an environmental control apparatus according to this description.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are substantially to scale, except where noted otherwise, such as in those instances in which proportions may have been exaggerated in order more clearly to depict certain features.

By way of general overview, given the fluctuations in outdoor external ambient temperature noted above, one way to reduce the likelihood of internal condensation on the windows, or to reduce the amount of condensate, the indoor humidity level may be adjusted downward when the outside air becomes colder. Conversely, as the outdoor temperature rises, the home occupant can safely bring the humidity set point higher for increased comfort without fear of condensation.

In that context, FIGS. 1*a*-1*h*, illustrate in a general, schematic manner the context of the apparatus. To that end, there is an enclosure structure generally indicated as a house 20. Although it is identified as "house 20" this is intended to be generic of houses, apartment buildings, schools, offices, factories, storage spaces, stores, and so on, and could as easily be identified as "building 20" or "warehouse 20".

House 20 has an environmental control apparatus 22 that may include an air conditioner, a furnace, a heating distribution system 24, and a control unit 40. Distribution system 24 may have, or be, a system of radiators or ducting and an air mover such as a forced-air blower. Environmental control apparatus 22 may sometimes be an HVAC system. Similarly, house 20 includes an humidification unit, i.e., an humidifier, 30. In some embodiments humidifier 30 may be separate from apparatus 22, in others it may be part of apparatus 22. Humidifier 30 may be located in the forced air distribution ducting downstream of the heating or cooling elements of the HVAC system. Where humidifier 30 is a separate unit or module, it may be controlled separately from environmental control apparatus 22 generally. That is, it may have a stand-alone control unit 41, separate from the control unit 39 of the heating and cooling systems. However, where humidifier 30 is part of apparatus 22 generally, it may share the same automated control unit. For the purpose of this explanation, a single control unit 40 may control both temperature and humidification functions. Since this need not be so, control unit 40 is shown with an intermittent demarcation separating the temperature functions and hardware (control unit 39) from the humidification functions and hardware (control unit 41). Control units 39 and 41 may be housed together, or they may be separate independent units. However it may be, each control unit has, or is, a processor, i.e., a CPU, for carrying out the various control functions. Control unit 39 has at least a first thermostat 26 at which the user inputs the desired internal temperature of house 20, or portions thereof. House 20 also has at least one temperature sensor 28 monitored by thermostat 26. Control unit 41 of humidifier 30 includes a humidistat 32 at which a relative humidity level is input. There is at least a first humidity sensor 34. Control unit 39 receives input values, i.e., input settings, for temperature, and monitors temperature sensor 28. Control unit 41 receives input values, i.e., input settings, for relative humidity and monitors humidity sensor 34. Control unit 41 also monitors temperature, whether at sensor 28, or at its own independent temperature sensor, or sensors, 38, e.g., in embodiments in which it is a separate unit. Even where temperature and humidity are controlled in a single unit, they may have different temperature sensors 28 and 38. Additionally, control unit 41 has a data download input 42, and a memory 44, which may be separate from any download input or memory of controller 39, or may be shared therewith. Data download input 42 is connected to a weather forecasting data source 46. There may be an external ambient temperature sensor 48, and a solar sensor 50. In some instances there may be a wind-speed sensor 52. Control unit 41 also includes a clock 54, which may be a shared clock with control unit 39. There may be a direct measurement of inside an outside glass surface temperature of one or more windows. The output of controller 41 is directed to govern operation of humidifier 30, as by turning humidifier motor 56 "On" or "Off". Apparatus 22 also include a water source 57 and a water control valve 58. House 20 has windows and doors, generically represented by window 36.

Memory 44 may be used, and in one embodiment is used, to store data pertaining to (a) weather data and weather rate-of-change data pertaining to the current weather forecast; (b) historic data characteristic of the thermal performance of the structure being heated, cooled, and humidified, such that the structure can be modelled for its thermal mass, the thermal resistance of the structure, and its effective thermal time constants, and the rate at which it loses humidity (in the Winter) or gains humidity (in the Summer), this last being a measure of the tightness and air exchange rate of the structure.

The data stored can be determined by recording the actual performance of the structure under known conditions in terms of the heat lost driving potential between the inside ambient temperature $T_{ai}$ and the outside ambient temperature $T_{ao}$. By measuring the rate of temperature difference decay with the heating and cooling system off, estimated values can be obtained or the thermal resistance of the structure. From these values, an expected temperature differential across the glazing may be estimated based on historic data. The thermal loss and humidity loss of the structure may also be a function of windspeed, solar radiation, external humidity, or external precipitation, and hence the various co-efficients may be adjusted according to variation in those parameters correlated with data downloaded from weather forecasting services or as observed at sensors 48, 50 and 52, for example.

Memory 44 also includes tabulated values of the ranges of acceptable internal relative humidity as a function of internal ambient temperature. Such as table may be as follows:

TABLE 1

| OUTDOOR TEMP | MAXIMUM INDOOR RELATIVE HUMIDITY @ 20° C. |
|---|---|
| −30° C. OR COLDER | 15% |
| −30° C. TO −24° C. | 20% |
| −24° C. TO −18° C. | 25% |
| −18° C. TO −12° C. | 35% |
| −12° C. TO 0° C. | 40% |

Data download input 42 is a data monitor at which control unit 40 receives weather forecast information. This information may be provided by a dedicated data-link, such as a phone line, or it may be provided through an internet connection.

Manually adjusting a humidistat according to changes in outdoor temperature may not generally be practical for widespread residential or commercial use. A self-adjusting humidistat using an outdoor temperature sensor is an improvement. However, installation of a wired outdoor sensor is a project that may not be readily undertaken by an average home-owner, for example. Wireless outdoor temperature sensors simplify the installation, but all outdoor temperature sensors require careful placement in order to avoid false readings from direct and/or reflected sunlight as well as snow and ice accumulation.

In addition to practical challenges, a self-adjusting humidistat using an outdoor temperature sensor is subject to control lag. Changes in the state of indoor humidity often fall behind changes in outdoor conditions as the response time for the indoor humidity to change is usually much slower than a change in outdoor temperature. The delay can be as long as several hours to several days depending on several variables related to the home structure and humidifier performance.

In that light, rather than reacting to actual changes in outdoor temperature, apparatus 22 provides an improved automatic self-adjusting humidistat. By downloading weather forecast data it anticipates future changes in outdoor temperature, and the timescale over which such changes may be expected to occur. Note that even a first derivate forward approximation of temperature or humidity relative to time may tend to provide a worthwhile improvement. In that context, apparatus 22 uses a self-tuning algorithm to self-correct, or self-adjust, the timing of changing the indoor humidity set point.

That is, to anticipate future changes in outdoor temperature, the automatic self-adjusting humidistat of apparatus 22 has a control algorithm that receives real-time temperature and humidity forecasting data for its geo-location. This information is stored in memory 44 of controller 40. It then compares the temperature and relative humidity of the space to be humidified with the expected conditions and the time lag to be expected in the structure. For example, if the initial manually elected relative humidity is higher than the maximum value of the range in Table 1, then controller 40 turns of the humidifier, i.e., turns off the electrical power to humidifier motor 56, until such time as the relative humidity at humidity sensor 34 falls below the bottom limit of the selected relative humidity range.

It may be noted that the humidity control of apparatus 20 is an On/Off control, with an upper limit, a lower limit, and a hysteresis band width between the upper and lower limits. The width of the hysteresis band is narrower than the width of the permissible humidity range at any given temperature in Table 1. Therefore, there may be an initial manual input selection of humidity that is in the middle of the range, or more moist than the middle, or less moist than the middle. Once the controller has established operation in a band in the middle of the selected range, it is able to stay between the upper and lower limits of the On/Off range.

It may be that the received temperature forecast data indicates that temperature is going to fall a certain amount over a given time period, e.g., as day turns to night. From the historical data, controller 40 has the parameters required to extrapolate forward humidity over time, e.g., as the inside surfaces of the glazing cool. It may then reduce the flow of humidification water to shift the humidity band to a lower level as the outside temperature cools. Since this process typically occurs over a number of hours, and since the predictive software has data to determine both the reduction in humidity level required and the time available, it can calculate the appropriate slope of the time rate of change of humidity, and adjust the center point of the On/Off hysteresis range accordingly, so that the humidity slowly steps down in increments over time.

This may perhaps be understood with the aid of FIGS. 2 and 3. For the purpose of this discussion, it is assumed that the building is house 20, and that the inhabitant sets both the desired internal temperature and the desired internal relative humidity at 10 a.m. Clearly this time is arbitrary, and is chosen for the convenience of explanation.

If the inside ambient temperature $t_{ai}$ of house 20 is constant, and the external ambient temperature $t_{ao}$ is constant, then the set point humidity would be represented by straight horizontal line 60. If that were so, then the controller would regulate humidity between the upper limit band shown by dashed line 62, and the lower limit band shown by dashed line 64. If that were the case, and assuming an On/Off control with a decaying exponential arc on both the humidifying (i.e., "On") and de-humidifying (i.e., "Off") portions of the cycle, the system would want to operate on a periodic sharktooth performance output between the upper and lower bands. However, FIG. 3 has been drawn to show that at night the upper band 62 would tend to intersect, and cross, the maximum permitted relative humidity line, 66, which conforms to Table 1 for outside temperature curve 70 and inside set point temperature 72 of FIG. 2. Conversely, in the warmest part of the day during the afternoon, the nominal set point curve 60 and the lower limit band 64 would intersect and cross under the minimum permitted relative humidity line 68.

In those respective situations, whatever value might have been set manually, the controller over-rides the manually set value to make sure that the observed result does not fall outside the range established by Table 1. Therefor, at roughly 1 p.m., the system would set a higher internal value to follow curve 68 to prevent the air in the building from becoming too dry. This condition would prevail until about 5:00 p.m. or 5:30 p.m. Later on, in the evening and night, near 2:00 a.m. the level of humidity might be too moist, and undesirable condensation might occur on the "On" leg of the saw tooth or shark tooth. Accordingly, when the upper limit is reached, the humidifier is shut off, and does not come back on until the lower band is intersected, and so on.

However, using the method and apparatus described herein, when the temperature and relative humidity set points are established by the inhabitant at 10:00 a.m., the first thing the controller does is to determine whether the set point input at humidistat 32 (in effect, the target value for humidity) is above or below the actual observed values. The controller establishes the difference between the actual value and the set point value. It then sends signals to the furnace, the air conditioner and the humidifier, as appropriate, to cause the system to work toward the input set point. Where only humidification is being controlled, the controller need not send signals to the air conditioner, or furnace, and need not be connected to either of them. Assuming that the system has reached a point within the range permitted under Table 1.

Looking only at humidity, in FIG. 3, if the controller concludes that the humidity needs to rise, then it looks for the value at the shut-off condition, i.e., the instantaneous value of the upper band. Based on the historic data for the structure, and based on the weather forecast data it has received, the controller can make an estimate of the time to run the humidifier, and the value of relative humidity it needs to establish to intersect the upper limit band of the curve. In this case, however, the controller will be following curve 80 which has been adjusted to account for the variation of the outside air temperature according to the weather forecast data stored in memory. Curve 80 has upper and lower "On-Off" bands shown as dashed lines 82 and 84 respectively. So, accordingly, the controller will be looking for an observed humidity value corresponding to the value of upper band 82, as at point 90 as indicated. Once this point has been reached the humidifier is shut off, and the humidity in the structure decays according to the loss and air interchange properties of the structure. These properties have also been stored in memory, and from these values controller 40 can estimate the intersection time and humidity at the next point 92, at which the humidifier it to be turned "On". Alternatively, values for some or all of these properties may have been entered into memory, such as values for (a) building volume; and (b) building heat loss co-efficients; (c) building moisture loss co-efficients; and (d) building air exchange rate co-efficients. Over time, controller 40 may record data to verify the accuracy of pre-programmed or manually input building structure properties, and may adjust the stored property values according to actual performance. Whether or not estimated, on both the "up" leg to point 90 and the "down" leg to point 92, the controller is constantly sampling at the humidity and temperature sensors to determine whether the humidity has fallen below the lower band intersection point for the outside temperature from the weather forecast for that time of day, as adjusted according to the properties of the structure. It also calculates whether the lower limit according to Table 1 has been crossed. To the extent that the time of intersection does not meet the predicted time, the controller can re-calculate the decay parameters for the structure. On a windy day, the decay may be faster than on a calm day, and the time to humidify the structure may be longer, for example.

When point 92 is reached, the humidifier is turned on, and the controller calculates the time and humidity at which it expects to intersect the upper band at point 94. It them monitors time, temperature, and humidity for convergence on the upper band limit. This process repeats over and over, throughout the day. So, it may be observed that the target for the 'On" or "Off" condition is not the nominal set point value but rather (a) the nominal set point value adjusted for (b) the external temperature curve; and (c) the half width (i.e., up or down) of the hysteresis loop between the "On" and "Off" bands to either side of the mean curve.

As may be noted, at some times of day the On portion of the cycle is longer or shorter, and the corresponding "Off" portion of the cycle depending on whether the external ambient temperature is rising or falling. Thus the time ratio or the "On" and "Off" portions of the curve will vary over time during the day.

In summary, in self-adjusting mode, the humidity set point will change, or be modified by the controller, in accordance with established industry guidelines relating outdoor temperature to an acceptable indoor relative humidity level such as may tend to prevent or to reduce condensation on windows 36. The value of the set point adjustment is obtained by comparing the user entered set point to maximum target set point values for indoor humidity at 20 C are as shown in Table 1.

In one embodiment, outdoor temperature is used to adjust the RH set point value to be the predicted lowest outdoor temperature value in the next 24 hours as downloaded from the external data source using values nearest to the system's geo-location. If the humidistat set-point is lower than the maximum indoor RH at the predicted outdoor temperature as per Table 1, no action is taken. If the user entered set-point is higher than the maximum indoor RH at the predicted outdoor temperature as per Table 1, the humidity set point will adjust to the maximum indoor RH value as per Table 1. To determine the optimum time to initiate an adjustment action, the system accumulates indoor temperature and relative humidity data to establish rates of change in humidity in its installed environment, from which the physical heat transfer constants of the structure can be determined. That is, the average rate of humidity loss is established using data recorded when the humidifier is not in operation. This rate is used to determine the time to stop humidification in order to reach a lower maximum set point. The average rate of humidity gain is established using data when the humidifier is in operation. This rate is used to determine a start time for recovery towards the user entered set point when safe to do so.

The foregoing apparatus and operation of that apparatus provide an auto-adjusting relative humidity set point based on forward looking data and calculation of rate of change (up/down) based on logic to determine optimum time for OFF and ON. The system also works to control input water flow, e.g., by controlling valve 58 to reduce wasted water. That is, based on the same approach to ramping supply to match the forward predicted set point by taking the difference between the current humidity and the predicted forward humidity in the next increment of time, and dividing that difference by the time available gives a calculated time rate of change. From the calculated physical properties of the structure based on past performance, the controller can determine the mean rate of operation required to reach the target set point at the future time. Where the outside temperature is rising, the level of humidification required, and consequently the mean flow of water to humidifier 30, will tend to be larger than when the outside temperature is falling and the system is letting the net flow of humidity out of the structure fall. In that context, the rate of inflow at valve 58 can be adjusted to correspond to the expected required flow over the approaching time period. This can also be achieved by sampling relative humidity at first and second points in time for a fixed water flow rate to humidifier 30. Where that flow rate does not keep the change in relative humidity within the On/Off hysteresis band to either side of the adjusted set point curve, then valve 58 is adjusted incrementally either to close or to open, as the case may be. At the next time interval, the calculation is made again, and valve 58 is adjusted up or down once more as appropriate to cause convergence of the sensed humidity level with the expected calculated adjusted curve. This occurs repeatedly. In this example, controller 41 may have sensors that monitor actual water flow rate, but it need not measure the absolute flow rate where controller 41 is operating on knowing whether "more" or "less" humidity is required, and adjusts valve incrementally over several time periods. Controller 41 does "know" the absolute position of valve 58, based on the recorded observations of its own historic operation and collection of data, and if, in future, it calculates that a given flow condition is required to reach the set point target over a given time interval, it can, based on that recorded historic data move valve 58 to the same condition as previously used to achieve the same time rate of change in building 20 more generally. So, it calculates the difference in future humidity from present humidity as delta(y), and the time available to make that change as delta(x). From this rate, the starting point value, and the time interval until the next data point, it calculates the expected end point at the end of the next time interval. It verifies that the calculated future end point humidity is within the permitted range of Table 1, and adjusts it accordingly if necessary. (I.e., if it isn't, then the slope dy/dx must be adjusted either up or down to follow a curve that will lie within the range of values of Table 1. This will give the nominal curve. The system then predicts the shape of the predicted saw-tooth On-Off curve and superposes that sawtooth on the base nominal curve to predict the next On/Off point. At any period in time, controller 41 senses the humidity at senor 32, and can evaluate whether the humidity in building 20 is following the expected course. If it is not following the expected course of the saw tooth at any given point in time, then humidifier motor 56 is be turned "On" or "Off" as appropriate to converge with the expected saw-tooth curve value at the given point in time, and, to the extent that humidifier 30 may then tend to use more or less water than predicted in that time interval, the water supply flow may be adjusted up or down at valve 58 to correspond to the change in needed supply.

Accordingly, by this calculated forward time-rate-of-change approximation, or forward estimate, then results in controller 41 adjusting the effective humidity range sought by humidifier 30, and adjusting the water supply rate yield a method by which automatically to adjust water flow supplied to humidifier 30 to tend to improve, or husband, water utilization by providing increased (or decreased) humidity with reduced water loss. This water loss based on external temperature variation (for a fixed internal set temperature) or based on both internal and external temperature variation may occur with or without a humidity sensor, such as sensor 32. U.S. Pat. No. 6,354,572 describes a method for metering water flow to humidifier to reduce wasted water. In that system of metering, the apparatus uses pre-set ON and OFF times for water supply and is not sensitive to external factors that influence humidifier performance such as (a) the amount of airflow (Q) created by the furnace; (b) the temperature of the water supply (Tw); (c) the temperature of the furnace air (Ta); and (d) the volume of the House being humidified.

In the system described herein, the apparatus of system 22 may include sensors operable to monitor any combination of those parameters, or to store volumetric data in memory.

By sensing and monitoring any combination of one or more of these factors, the self-tuning, or self-adjusting, control adjusts the water supply ON (valve 58 open) pad quenching time and OFF time (valve 58 closed) pad drying time in order to increase or decrease the amount of water flowing to humidifier 30, and to reduce the water flowing to drain. This is accomplished by collecting, storing and comparing the rate of change in humidity during a humidification cycle, using that data to adjust water valve 58 OPEN/CLOSED times. A sensor may, or may not be located downstream of humidifier 30 to verify water flow to drain.

The features of the various embodiments may be mixed and matched as may be appropriate without the need for further description of all possible variations, combinations, and permutations of those features.

The principles of the present invention are not limited to these specific examples which are given by way of illustration. It is possible to make other embodiments that employ the principles of the invention and that fall within its spirit and scope of the invention. Since changes in and or additions to the above-described embodiments may be made without departing from the nature, spirit or scope of the invention, the invention is not to be limited to those details, but only by the appended claims.

We claim:

1. A method of controlling humidity within a building, said method including:

providing at least a first temperature sensor inside said building and using said temperature sensor to monitor temperature within said building;

providing at least a first humidistat at which to input an humidity value;

providing at least a first humidity sensor within said building and using said humidity sensor to monitor humidity within said building;

obtaining weather forecast data;

providing a memory of thermal properties of said building; and providing a processor;

operating said processor to receive input values from at least said first temperature sensor, at least said first humidistat, and said weather forecast data;

operating said processor to monitor observed temperature and observed humidity at least at said first temperature sensor and at least at said first humidity sensor respectively;

operating said processor to make a forward projection of humidity level within said building as a function of said weather forecast data; and using output environmental control signals from said processor to adjust humidity within said building toward said forward projection of humidity level to forward-adjust humidity within said building as a function of said weather forecast data.

2. The method of claim 1 wherein said step of providing a memory of thermal properties of said building includes storing thermal performance data of said building, and said method includes using said thermal performance data in said step of forward adjusting said humidity.

3. The method of claim 1 wherein said step of providing a memory of thermal properties of said building includes collecting thermal performance data from said building over time, storing said thermal performance data of said building, calculating thermal performance co-efficients of said building from said thermal performance data; and said method includes using said thermal performance co-efficients in said step of forward-adjusting humidity in said building.

4. The method of claim 1 wherein said method includes obtaining said weather forecast data from a data source by at least one of (a) a radio signal; and (b) a telephonic signal.

5. The method of claim 1 wherein said method includes storing a set of data establishing upper and lower humidity limits, and maintaining humidity adjustments within said upper and lower humidity limits.

6. The method of claim 1 wherein the input humidity value establishes a humidity set point, and said method includes establishing upper and lower bands to said humidity set point, and operating an On-Off humidification process between said upper and lower bands of said humidity set point.

7. The method of claim 1 wherein said method includes monitoring outdoor temperature, comparing outdoor temperature with previously forecast temperature, and adjusting humidification to account for a difference between forecast external ambient temperature and actual external ambient temperature.

8. The method of claim 1 wherein said method includes obtaining external source inputs for at least one of (a) external relative humidity; and (b) precipitation; and calculating alternate thermal properties of the building adjusted therefor, and using said adjusted thermal properties when calculating humidity adjustment.

9. The method of claim 1 wherein said method includes:

collecting thermal performance data from said building over time;

storing said thermal performance data of said building;

calculating thermal performance co-efficients of said building from said thermal performance data;

using said thermal performance co-efficients in said step of forward-adjusting humidity in said building; and storing a set of data establishing upper and lower humidity limits, and maintaining humidity adjustments within said upper and lower humidity limits.

10. The method of claim 1 wherein said input humidity value establishes a humidity set point and said method includes:

establishing upper and lower bands to said humidity set point, and operating an On-Off humidification process between said upper and lower bands of said humidity set point;

monitoring outdoor temperature, comparing outdoor temperature with previously forecast temperature, and adjusting humidification to account for a difference between forecast external ambient temperature and actual external ambient temperature; and obtaining external source inputs for at least one of (a) external relative humidity; and (b) precipitation; and calculating alternate thermal properties of the building adjusted therefor, and using said adjusted thermal properties when calculating humidity adjustment.

11. The method of claim 1 wherein said method includes providing a water source input and a valve mounted to control water flow through said water source input, and operating said processor to output environmental control signals to adjust water flow through said valve.

12. The method of claim 1 wherein said building has a furnace that produces an amount of airflow, the airflow having a furnace air temperature, there is a water supply through which inflowing water is obtained, the water having a water temperature, and said method includes providing at least one sensor mounted to monitor at least one of (a) the amount of airflow (Q) created by the furnace;

(b) the temperature of the water supply (Tw); and (c) the temperature of the furnace air (Ta).

13. The method of claim 1 wherein said method includes storing input data values for at least one of (a) building volume; and (b) building heat loss co-efficients; (c) building moisture loss co-efficients; and (d) building air exchange rate co-efficients.

14. A method of controlling humidity within a building, said method including:

providing at least a first temperature sensor and using said first temperature sensor to monitor temperature inside said building;

providing at least a first humidistat at which to input a set humidity value;

providing at least a first humidity sensor, and using said humidity sensor to monitor humidity inside said building;

obtaining weather forecast data;

providing a water source input and a valve mounted to govern flow of water therefrom;

providing a memory and storing thermal properties of said building in said memory; and providing a processor;

operating said processor to receive input values from at least said first temperature sensor at least said first humidistat, and said weather forecast data;

operating said processor to monitor observed temperature and observed humidity at least at said first temperature sensor and at least at said first humidity sensor respectively;

operating said processor to make a forward projection of humidity level within said building as a function of said weather forecast data input; and operating said processor to output environmental control signals to adjust water flow through said valve to forward-adjusting humidity within said building as a function of said weather forecast data.

15. The method of claim 14 wherein said building has a furnace that produces an amount of airflow, the airflow having a furnace air temperature, there is a water supply through which inflowing water is obtained, the water having a water temperature, and said method includes providing at least one sensor mounted to monitor at least one of (a) the amount of airflow (Q) created by the furnace;

(b) the temperature of the water supply (Tw); and (c) the temperature of the furnace air (Ta).

16. The method of claim 14 wherein said method includes storing in said memory input data values for at least one of (a) building volume; and (b) building heat loss co-efficients; (c) building moisture loss co-efficients; and (d) building air exchange rate co-efficients among the thermal properties of said building stored in said memory.

17. The method of claim 14 wherein said step of providing a memory of thermal properties of said building includes collecting thermal performance data from said building over time, storing said thermal performance data of said building, calculating thermal performance co-efficients of said building from said thermal performance data; and said method includes using said thermal performance co-efficients in said step of forward-adjusting humidity in said building.

18. The method of claim 14 wherein said method includes obtaining said weather forecast data from a data source by at least one of (a) a radio signal; and (b) a telephonic signal.

19. The method of claim 14 wherein the input humidity value establishes a humidity set point, and said method includes establishing upper and lower bands to said humidity set point, and operating an On-Off humidification process between said upper and lower bands of said humidity set point.

20. The method of claim 14 wherein said method includes at least one of:

(i) monitoring outdoor temperature, comparing outdoor temperature with previously forecast temperature, and adjusting humidification to account for a difference between forecast external ambient temperature and actual external ambient temperature; and (ii) obtaining external source inputs for at least one of (a) external relative humidity; and (b) precipitation; and calculating alternate thermal properties of the building adjusted therefor, and using said adjusted thermal properties when calculating humidity adjustment.

* * * * *